US009731311B2

(12) United States Patent
Fritz et al.

(10) Patent No.: US 9,731,311 B2
(45) Date of Patent: Aug. 15, 2017

(54) PAINTING SYSTEM COMPONENT HAVING A SURFACE COATING

(75) Inventors: Hans-Georg Fritz, Ostfildern (DE); Hans-Jürgen Nolte, Besigheim (DE); Timo Beyl, Besigheim (DE); Marcus Kleiner, Ingersheim (DE)

(73) Assignee: Durr Systems GmbH, Bietigheim-Bissingen (DE)

( * ) Notice: Subject to any disclaimer, the term of this patent is extended or adjusted under 35 U.S.C. 154(b) by 319 days.

(21) Appl. No.: 13/514,454

(22) PCT Filed: Dec. 3, 2010

(86) PCT No.: PCT/EP2010/007356

§ 371 (c)(1),
(2), (4) Date: Aug. 21, 2012

(87) PCT Pub. No.: WO2011/069622

PCT Pub. Date: Jun. 16, 2011

(65) Prior Publication Data

US 2012/0305681 A1 Dec. 6, 2012

(30) Foreign Application Priority Data

Dec. 8, 2009 (DE) ..... 10 2009 057 444

(51) Int. Cl.
*B05B 3/10* (2006.01)
*B05B 15/02* (2006.01)

(52) U.S. Cl.
CPC ..... *B05B 15/02* (2013.01); *B05B 3/1014* (2013.01)

(58) Field of Classification Search
USPC ..... 239/223
See application file for complete search history.

(56) References Cited

U.S. PATENT DOCUMENTS

| | | | | |
|---|---|---|---|---|
| 4,275,838 | A | 6/1981 | Fangmeyer | |
| 4,525,417 | A | 6/1985 | Dimigen et al. | |
| 5,923,944 | A | 7/1999 | Coffinberry et al. | |
| 5,934,574 | A * | 8/1999 | van der Steur | 239/690.1 |
| 6,660,363 | B1 | 12/2003 | Barthlott | |
| 7,196,043 | B2 | 3/2007 | Valpey, III et al. | |
| 7,837,135 | B2 * | 11/2010 | Nolte et al. | 239/700 |
| 2002/0066808 | A1 | 6/2002 | Fiala et al. | |

(Continued)

FOREIGN PATENT DOCUMENTS

| | | | |
|---|---|---|---|
| CN | 1337984 | A | 2/2002 |
| CN | 101368262 | A | 2/2009 |

(Continued)

OTHER PUBLICATIONS

International Search Report, PCT/EP2010/007356, May 31, 2011.

(Continued)

*Primary Examiner* — Arthur O Hall
*Assistant Examiner* — Adam J Rogers
(74) *Attorney, Agent, or Firm* — Bejin Bieneman PLC

(57) ABSTRACT

The disclosure relates to a painting system component, in particular a rotating bell (1) for a rotating atomizer, including a main body (1) and a surface coat (8) at least on a part of the surface of the main body (1). The surface coat (8) reduces the tendency of the painting system component to become dirty and/or improves the ease of cleaning of the painting system component.

20 Claims, 2 Drawing Sheets

(56) References Cited

U.S. PATENT DOCUMENTS

| | | | | |
|---|---|---|---|---|
| 2003/0003328 | A1* | 1/2003 | Spitsberg et al. | 428/698 |
| 2003/0010841 | A1* | 1/2003 | Kon | 239/224 |
| 2003/0080221 | A1* | 5/2003 | Seitz | B05B 3/1042 239/700 |
| 2004/0110016 | A1* | 6/2004 | Hamaya et al. | 428/472 |
| 2007/0284255 | A1* | 12/2007 | Gorokhovsky | C22C 38/44 205/89 |
| 2009/0011222 | A1* | 1/2009 | Xiu et al. | 428/323 |
| 2009/0212122 | A1* | 8/2009 | Nolte et al. | 239/1 |
| 2010/0280164 | A1* | 11/2010 | Heikkila et al. | 524/443 |
| 2010/0330340 | A1* | 12/2010 | Rothstein et al. | 428/167 |
| 2013/0256944 | A1* | 10/2013 | Victor et al. | 264/220 |
| 2014/0147654 | A1* | 5/2014 | Walther et al. | 428/312.6 |

FOREIGN PATENT DOCUMENTS

| | | | |
|---|---|---|---|
| CN | 101492795 | A | 7/2009 |
| CN | 101522822 | A | 9/2009 |
| DE | 4439924 | A1 | 5/1996 |
| DE | 10112854 | A1 | 10/2001 |
| DE | 102005004081 | A1 | 8/2006 |
| DE | 102006005765 | A1 | 8/2007 |
| DE | 102006011391 | B4 | 8/2007 |
| DE | 102006022057 | B3 | 10/2007 |
| EP | 0087836 | A1 | 9/1983 |
| WO | WO9604123 | A1 | 2/1996 |

OTHER PUBLICATIONS

Search Report by the State Intellectual Property Office of the People's Republic of China dated Sep. 18, 2014 (1 page).

Supplementary Search Report by the State Intellectual Property Office of the People's Republic of China for Chinese Application 201080055783.3 dated May 18, 2015 (English translation provided; 2 pages).

Schork, Willi, "Reibungsminderung an Antriebs—und Motorkomponenten durch Beschichtungen mit diamantähnlichem amorphen Kohlenstoff (Dissertation)", Fraunhofer Verlag 18. März 2010 (Mar. 18, 2010), XP055336206, http://publica.fraunhofer.de/documents/N-120122.html ISBN: 978-3-8396-0101-3 (with English translation; 13 pages).

EPO Office Action for Application No. 10787321.8-1760 dated Feb. 2, 2017 (6 pages).

* cited by examiner

PAINTING SYSTEM COMPONENT HAVING A SURFACE COATING

CROSS-REFERENCES TO RELATED APPLICATIONS

This application is a National Stage application which claims the benefit of International Application No. PCT/EP2010/007356 filed Dec. 3, 2010, which claims priority based on German Application No. DE 10 2009 057 444.1, filed Dec. 8, 2009, both of which are hereby incorporated by reference in their entireties.

BACKGROUND

The present disclosure relates to a painting installation component, particularly a bell cup for a rotary atomizer, according to the preamble of Claim 1. Furthermore, the present disclosure includes a corresponding manufacturing method.

Rotary atomizers, which comprise a rotating bell cup as the application element are usually used for the painting of motor vehicle body components. Problematic here is the fact that the bell cup is contaminated during painting operation both on external surfaces (e.g. lateral surface) and on inner surfaces (e.g. overflow surface) with the applied paint, wherein the paint to some extent adheres very strongly on the surface of the bell cup. In the case of a change in coating agent, a relatively large quantity of rinsing agent must therefore be used in order to clean the bell cup of the adhering residues of the old coating agent, for which a relatively large period of time is also required. This also applies for the so-called quick rinsing, which is carried out between the coating of individual coating objects (e.g. motor vehicle bodies). A disadvantage of conventional bell cups is therefore the tendency to contamination and the reduced cleaning ability.

Furthermore, the surfaces, particularly the overflow surfaces, of the conventional bell cups are subject to a wear by means of corrosion and/or abrasion, as a result of which the surface roughness is increased, which in turn increases the requirements for the cleaning of the bell cup.

It is known from DE 101 12 854 A1 to coat the surface of a bell cup of this type in order to increase the abrasion resistance and as a result to reduce wear. These known surface coatings do not, however, solve the problem of a tendency to contamination or the unsatisfactory cleaning ability of the bell cup.

Accordingly there is a need to reduce the tendency for contamination of the bell cup.

BRIEF DESCRIPTION OF THE FIGURES

While the claims are not limited to the specific illustrations described herein, an appreciation of various aspects is best gained through a discussion of various examples thereof. Referring now to the drawings, illustrative examples are shown in detail. Although the drawings represent the exemplary illustrations, the drawings are not necessarily to scale and certain features may be exaggerated to better illustrate and explain an innovative aspect of an illustration. Further, the exemplary illustrations described herein are not intended to be exhaustive or otherwise limiting or restricting to the precise form and configuration shown in the drawings and disclosed in the following detailed description. Exemplary illustrations are described in detail by referring to the drawings as follows:

DETAILED DESCRIPTION

Figure 1:
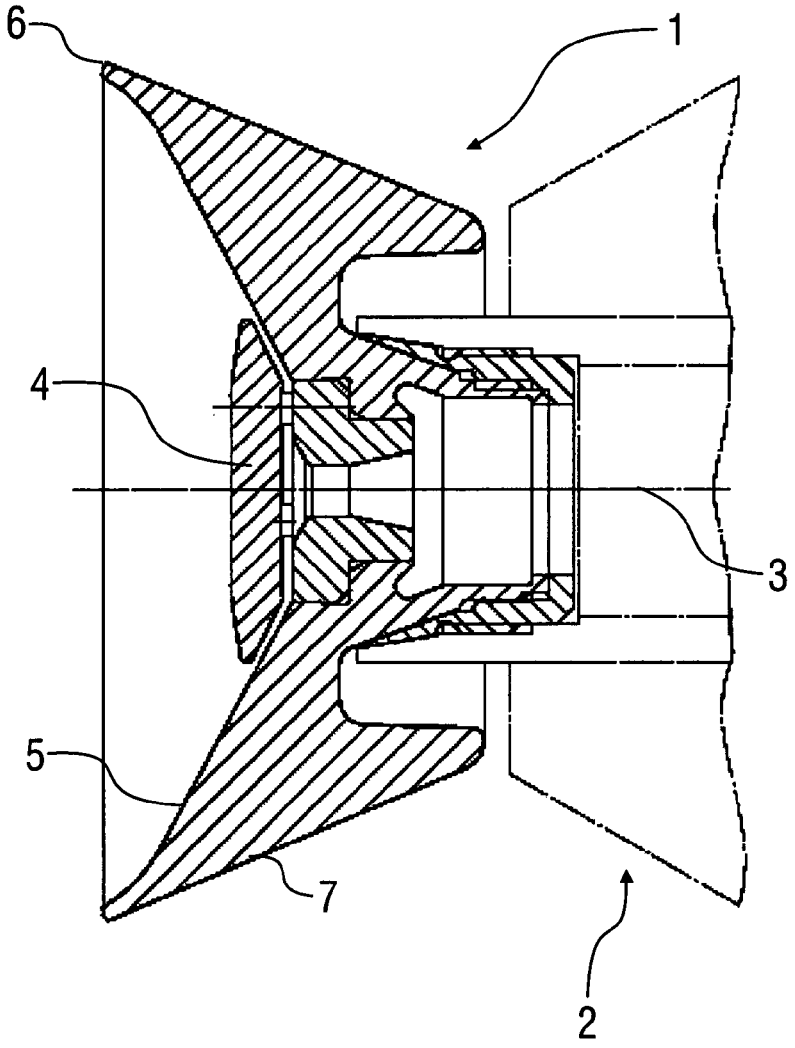
FIG. 1 a cross-sectional view of a bell cup according to the present disclosure on a rotary atomizer, FIG. 2 a cross-sectional view of a bell cup according to the present disclosure, in which the surface layer only covers parts of the bell cup, FIG. 3 a cross-sectional view of a bell cup according to the present disclosure, in which the surface layer covers the outer lateral surface and the rear side of the bell cup, FIG. 4 a cross-sectional view through another exemplary illustration of a bell cup according to the present disclosure, wherein the surface layer covers the entire bell cup, and also FIG. 5 a cross-sectional view of a bell cup according to the present disclosure, in which the surface layer only covers the inner surface and the overflow surface of the bell cup.

In the context of the present disclosure, provision is made for a painting installation component (e.g. bell cup) to have a surface layer which reduces the tendency to contamination and/or improves the cleaning ability.

The base body itself can in the context of the present disclosure consist for example of aluminum or an aluminum alloy, titanium, steel, stainless steel, non-ferrous metal (copper and alloys thereof), ceramic, plastic or a combination of these materials.

The surface layer can in the context of the present disclosure contain oxides, nitrides and/or carbides, wherein for example boron, molybdenum, tantalum, niobium, vanadium, zirconium, silicon, chromium, titanium, carbon, nickel and fluorine compounds are suitable as (base) materials for the surface layer.

In a preferred exemplary embodiment of the present disclosure, the surface layer consists of a material based on Si—O, Si—OH or silicon organic compounds, particularly in the form of a nanolayer, as is further described in detail.

Furthermore, it is to be noted that the surface layer preferably contains metal oxides, metal nitrides or a metal-organic compound.

Furthermore, it is to be mentioned that the surface layer can optionally consist of an organic, particularly metal-organic material or of an inorganic material.

Depending on the coating agent to be used, the surface layer can either be hydrophilic or hydrophobic. A hydrophilic surface layer stands out on account of a contact angle with respect to water which is smaller than 90°, 45°, 20°, 10°, 8° or even smaller than 6°. Furthermore, the surface layer can even be superhydrophilic, wherein the surface layer stands out on account of a contact angle with respect to water of less than 5°, 3°, 2° or even less than 1°. In the case of a hydrophobic surface layer, the contact angle with respect to water is by contrast larger than 90°, 110°, 130° or 150°. In the context of the present disclosure, there is even the possibility that the surface layer is superhydrophobic, wherein the contact angle with respect to water is larger than 160°, 180°, 200° or even 220°.

Furthermore, in the context of the present disclosure, there is the possibility that the surface layer is a so-called nanolayer. Nanolayers of this type are known per se from the prior art and therefore do not need to be described in more detail. At this point, it need only be mentioned that nanolayers generally consist of nanoparticles with a size of less than 100 nm. 0.000 003 937 inches), which settle in the surface roughnesses and thereby seal the surface, which leads to a considerably reduced surface roughness. With a nanolayer of this type, a lotus effect of the component surface can also be realized, which leads to a self-cleaning component surface. The term nanolayer used in the context of the present disclosure is therefore preferably based on a surface layer, which contains particles, the particle size of which lies in the nanometer range. However, additionally or alternatively, there is the possibility that the nanolayer has a layer thickness which lies in the nanometer range.

Furthermore, in the context of the present disclosure, there is the possibility that the surface layer has a microstructuring in order to reduce the tendency to contamination. For example, U.S. Pat. No. 6,660,363 discloses a self-cleaning component surface which combines a microstructure with a hydrophobic coating to achieve the self-cleaning effect. The entire content of which is therefore incorporated by reference herein.

Furthermore, the surface layer according to the present disclosure can fulfill a further technical function in that the surface layer is wear reducing for example, in patent application DE 101 12 854 A1 which is incorporated by reference herein.

In a variant of the present disclosure, the base body and the surface layer consist of the same basic material, wherein the material properties of the surface layer are changed in a targeted manner in order to reduce the tendency to contamination of the painting installation component and/or to improve the cleaning ability. For example, the surface of the base body can to this end be sprayed with spraying technologies (e.g water jets, ceramic bead jets, glass beads, etc.), in order to correspondingly change the surface properties. Alternatively, there is the possibility that the surface of the base body is irradiated with a laser or etched to produce the desired material properties. Further, in the context of this variant of the present disclosure, there is the possibility that the surface layer is created by plasma methods, for example by means of plasma-electrolytic oxidation (PEO technology).

In another variant of the present disclosure, the base body and the surface layer by contrast consist of different basic materials, wherein the surface layer is applied as surface coating onto the base body. For example, this application of the surface layer can take place by means of physical vapor deposition (PVD: Physical Vapor Deposition) or by other methods.

Further possible methods for applying or creating the surface layer are vapor deposition (CVD: Chemical Vapor Deposition), etching, laser irradiation, ion implantation, spray technologies (e.g. water jets, ceramic bead jets, glass bead jets) and classic coating methods, such as e.g. spraying, dipping, atomization, painting, which lend themselves to the application of organic surface layers in particular.

To achieve specific surface layers, it may make sense in the context of the present disclosure to apply a plurality of part layers with different material properties lying one above the other, wherein the part layers lying one above the other may differ for example with regards to ductility, friction, wettability, roughness depth, corrosion resistance or wear resistance.

Furthermore, in the context of the present disclosure, there is the possibility that the surface layer has a plurality of regions which are separated from one another and have different properties. In a region which is strongly mechanically loaded, the surface layer may for example be optimized more strongly with a view to an abrasion resistance which is as large as possible, whereas the good cleaning ability is of lower priority at places of this type. In surface regions, which are strongly exposed to the paint and furthermore can only be accessed with difficulty, the surface layer can by contrast primarily be optimized with a view to a tendency to contamination which is as low as possible, whereas the abrasion resistance is only of lower priority in these regions.

Furthermore, it is to be mentioned that the surface layer can consist of a material with a high, medium or low boundary surface friction.

The same also applies analogously for the wettability of the surface layer, which may optionally consist of a material with a very good, good or low/poor wettability.

Also, with respect to the ductility, in the context of the present disclosure, there are a plurality of possibilities which can be selected depending on the purpose. For example, the surface layer can consist of a material with a high ductility, particularly with an elongation at break of more than 5% or 10%. Alternatively, however, there is the possibility that the surface layer consists of a material with a medium ductility, particularly with an elongation at break between 0.5 and 5%. Further, there is also the possibility that the surface layer consists of a material with a low ductility, particularly with an elongation at break of less than 0.5%, 0.3% or 0.1%.

Furthermore, the surface layer may consist of a material with a large roughness (e.g. Rz>50 μm (0.001 968 inches)), a medium roughness (e.g. Rz=10 μm-50 μm (0.000 393-0.001 968 inches)) or a low roughness (e.g. Rz<10 μm (0.000 393 inches)).

Also, with respect to abrasion resistance, there are various possibilities, so that the surface layer can optionally consist of a material with a high, medium or low abrasion resistance.

Further, with respect to corrosion resistance of the surface layer also, there are also various possibilities depending on the purpose, so that the surface layer can optionally consist of a material with a large, medium or small corrosion resistance.

The corrosion resistance is particularly important if the paint-installation component (e.g. bell cup) consists of non-ferrous metal (copper and alloys thereof), as non-ferrous metals also corrode in contact with deionised water (DI water). This is important, because DI water is contained in water-based paints and water-based rinsing agents, so that bell cups made from non-ferrous metals must be coated with a corrosion-resistant surface layer.

The previously mentioned possibilities for material properties may also be combined with one another in a targeted manner in order to achieve certain properties.

For an atomization of the coating agent, which is as fine as possible, it is for example advantageous to combine the following material properties of the surface layer with one another: low boundary surface friction, low wettability, high ductility, low roughness, large abrasion resistance and low corrosion resistance.

To achieve a cleaning ability which is as good as possible, it is by contrast advantageous to combine the following material properties with one another: medium boundary surface friction, high wettability, medium ductility, low roughness, low abrasion resistance and very good corrosion resistance.

To achieve a corrosion protection of aluminum, it may be advantageous to combine the following material properties with one another: medium boundary surface friction, low wettability, high ductility, low roughness, low abrasion resistance and very good corrosion resistance.

In a variant of the present disclosure, the cleaning-optimizing surface layer covers the entire surface of the base body.

In another variant of the present disclosure, the cleaning-optimizing surface layer by contrast only covers external surfaces of the base body. In the case of a bell cup, preferably the lateral surface and/or the rear side of the base body is covered with the surface layer.

In a further variant of the present disclosure by contrast, only an inner surface of the base body is covered with the surface layer. In the case of a bell cup, this may for example be an overflow surface.

In a further variant of the present disclosure, the surface layer covers the surface of the base body by contrast only at part regions which are in need of an optimization of the cleaning properties. For example, this may be the regions of the lateral surface and the overflow surface, which directly border the spraying edge.

The principle according to the present disclosure of an improvement of the cleaning ability is not only suitable for bell cups of rotary atomizers, but rather is also suitable for other paint-conveying components, such as for example a valve housing or valve needles. Furthermore, the present disclosure is also suitable for improving other paint-installation components, which come into contact with a coating agent, such as for example atomizers (e.g. rotary atomizers), robot hand axes, robot arms or flanges. In general, the present disclosure is suitable for improving the cleaning ability or the tendency to contamination of components of a painting robot or a handling robot (e.g. door openers, hood openers). Finally, the present disclosure is also suitable for reducing the tendency to contamination or for improving the cleaning ability of components of a painting booth, such as for example covers, grates, conveyors, window panes, wall elements or exhaust air ducts.

Furthermore, it is additionally to be mentioned that the present disclosure is not limited to a single painting installation component (e.g. bell cup) which is optimized with regards to its tendency to contamination or cleaning ability. Rather, the present disclosure also comprises a rotary atomizer with a bell cup optimized according to the present disclosure, as well as a complete painting robot with a rotary atomizer of this type.

Finally, the present disclosure also comprises a manufacturing method for manufacturing a painting installation component (e.g. bell cup) optimized according to the present disclosure, as emerges already from the preceding description.

Other advantageous developments of the present disclosure are characterized in the subclaims or are explained in more detail below together with the description of the preferred exemplary illustrations of the present disclosure on the basis of the figures. The figures show as follows:

FIG. 1 shows a widely conventional bell cup 1 for a rotary atomizer 2, wherein the bell cup 1 rotates about an axis of rotation 3 during operation.

The paint to be applied is here supplied to the bell cup 1 by means of a paint pipe and then impinges axially onto a baffle plate 4 which deflects the paint in the radial direction.

The paint then flows along an overflow surface 5 to an annularly circumferential spraying edge 6 at which the paint is sprayed.

Furthermore, the bell cup 1 has a conical lateral surface 7 at its outer side, which is likewise known per se from the prior art.

The present disclosure provides then for the bell cup 1 to be coated at its surface with a surface layer which reduces the tendency to contamination and improves the cleaning ability. This surface layer is here applied to the overflow surface 5 and the paint-conveying inner surfaces of the bell cup 1 and furthermore also extends over the entire lateral surface 7. It is however also possible in the context of the present disclosure that the entire surface of the bell cup 1 is sealed with the surface coating.

The surface layer according to the present disclosure in this exemplary illustration contains a nanolayer, which realizes a lotus effect so that the bell cup 1 is self-cleaning and at most requires a short cleaning.

Figure 2:
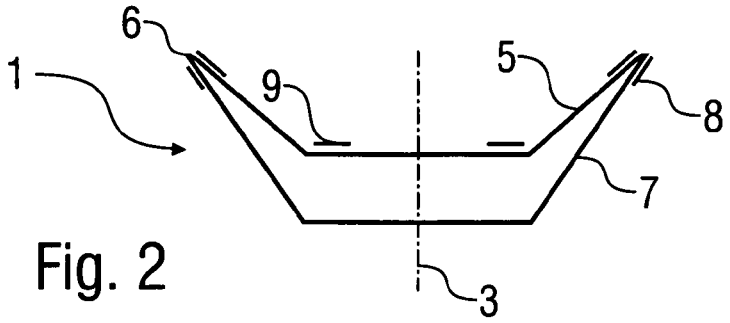

The exemplary illustration as shown in FIG. 2 corresponds to a great extent with the above-described exemplary illustration so that, in order to avoid repetition, reference is made to the above description, wherein the same reference numerals are used for corresponding details.

A particularity of this exemplary illustration consists in the fact that the bell cup 1 only has a surface layer 8 in the region of its spraying edge 6, wherein the surface layer 8 is located both at the overflow surface 5 and at the outer lateral surface 7.

Furthermore, a region 9 is also located at the inner surface of the bell cup 1, which is provided with a surface layer, which reduces the tendency to contamination and improves the cleaning ability.

Figure 3:
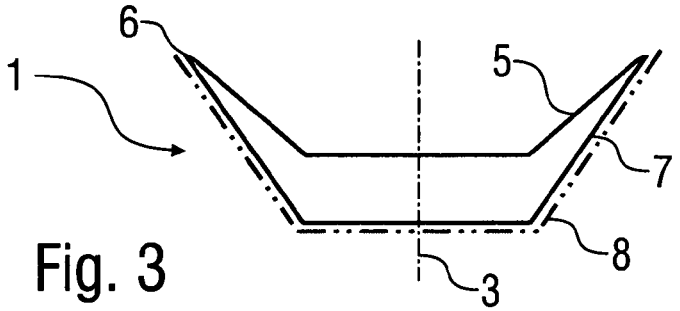

The exemplary illustration as shown in FIG. 3 again corresponds to a great extent with the above-described exemplary illustration s so that, in order to avoid repetition, reference is made to the above description, wherein the same reference numerals are used for corresponding details.

This exemplary illustration stands out on account of the fact that the surface layer only covers the outer lateral surface 7 and the rear side of the bell cup 1, whereas the overflow surface 5 and the inner surface of the bell cup 1 remain uncoated.

Figure 4:
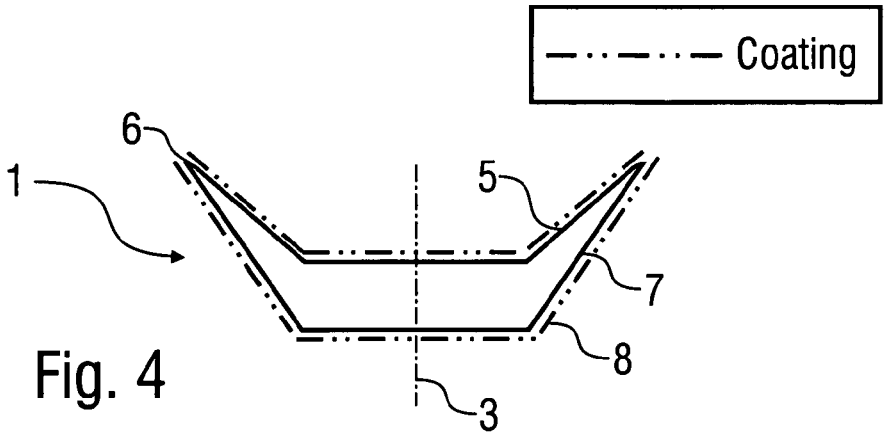

The exemplary illustration as shown in FIG. 4 again corresponds to a great extent with the above-described exemplary illustrations so that, in order to avoid repetition, reference is made to the above description.

This exemplary illustration stands out on account of the fact that the bell cup 1 is sealed completely with the surface layer 8. This means that the entire surface of the bell cup 1 is covered by the surface layer 8.

Figure 5:
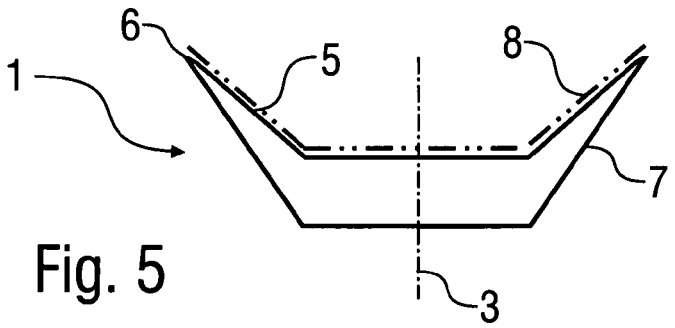

Also, the exemplary illustration as shown in FIG. 5 corresponds to a great extent with the above-described exemplary illustrations so that, in order to avoid repetition, reference is made to the above description.

A particularity of this exemplary illustration consists in the fact that only the overflow surface 5 and the inner surface of the bell cup 1 is coated with the surface layer.

The exemplary illustrations are not limited to the previously described examples. Rather, a plurality of variants and modifications are possible, which also make use of the ideas of the exemplary illustrations and therefore fall within the protective scope. Furthermore the exemplary illustrations also include other useful features, e.g., as described in the subject-matter of the dependent claims independently of the features of the other claims.

Reference in the specification to "one example," "an example," "one embodiment," or "an embodiment" means that a particular feature, structure, or characteristic described in connection with the example is included in at least one example. The phrase "in one example" in various places in the specification does not necessarily refer to the same example each time it appears.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain examples, and should in no way be construed so as to limit the claimed invention.

Accordingly, it is to be understood that the above description is intended to be illustrative and not restrictive. Many examples and applications other than those specifically provided would be evident upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future examples. In sum, it should be understood that the invention is capable of modification and variation and is limited only by the following claims.

All terms used in the claims are intended to be given their broadest reasonable constructions and their ordinary meanings as understood by those skilled in the art unless an explicit indication to the contrary is made herein. In particular, use of the singular articles such as "a," "the," "the," etc. should be read to recite one or more of the indicated elements unless a claim recites an explicit limitation to the contrary.

LIST OF REFERENCE NUMERALS

1 Bell cup
2 Rotary atomizer
3 Axis of rotation
4 Baffle plate
5 Overflow surface
6 Spraying edge
7 Lateral surface
8 Surface layer
9 Coated region

The invention claimed is:

1. A painting installation component for directing application of a coating agent, comprising: an annular cup body including one of aluminum, titanium and aluminum oxide materials, the cup body having an at least partially radially inward-facing overflow surface and an at least partially radially outward-facing lateral surface, the cup body having a spraying edge between the overflow surface and the lateral surface, the cup body being configured to receive the coating agent flowing towards the spraying edge within a region bounded by the overflow surface and to direct the coating agent away from the cup body outside of the spraying edge; and a first body coating layer having a base material of niobium and extending on the outwardly facing lateral surface at least part of the cup body, the first body coating layer and the cup body interfacing at a first ion implantation bond, and the inward-facing overflow surface not having a niobium material, and the coating material being made only from niobium, wherein the first body coating layer is configured to provide a coating adherence between a residue of the coating agent and the first body coating layer, the coating adherence being less than a body adherence between the residue of the coating agent and the cup body.

2. The painting installation component of claim 1, wherein the first body coating layer includes a material with a ductility with an elongation at break of more than 5%.

3. The painting installation component of claim 1, wherein the first body coating layer includes a material with a ductility with an elongation at break between 0.5% and 5%.

4. The painting installation component of claim 1, wherein the first body coating layer includes a material with a ductility with an elongation at break of less than 0.5%.

5. The painting installation component of claim 1, wherein the first body coating layer includes a material with an Rz roughness coefficient larger than 50 μm.

6. The painting installation component of claim 1, wherein the first body coating layer includes a material with an Rz roughness coefficient between 10 μm and 50 μm.

7. The painting installation component of claim 1, wherein the first body coating layer includes a material with an Rz roughness coefficient of less than 10 μm.

8. The painting installation component of claim 1, wherein the first body coating layer is a nanolayer.

9. The painting installation component of claim 8, wherein the nanolayer includes nanoparticles with a size of less than 100 nm.

10. The painting installation component of claim 1, wherein the first body coating layer is hydrophilic with a contact angle less than 90°.

11. The painting installation component of claim 1, wherein the first body coating layer is superhydrophilic with a contact angle less than 5°.

12. The painting installation component of claim 1, wherein the first body coating layer is hydrophobic with a contact angle greater than 90°.

13. The painting installation component of claim 1, wherein the first body coating layer is superhydrophobic with a contact angle greater than 180°.

14. The painting installation component of claim 1, wherein the first body coating layer has a ductility with an elongation at break between 0.5% and 5%, and wherein the first body coating layer has an Rz roughness coefficient of less than 10 μm.

15. The painting installation component of claim 14, wherein the first body coating layer includes one of a metal oxide, a metal nitride, and a metal-organic compound, and wherein the first body coating layer is a nanolayer including nanoparticles with a size of less than 100 nm.

16. The painting installation component of claim 1, wherein the first body coating layer extends onto the lateral surface of the cup body.

17. The painting installation component of claim 16, wherein the first body coating layer is bounded by the lateral surface of the cup body.

18. The painting installation component of claim 16, further comprising a second body coating layer having a base material of niobium and extending on at least part of the overflow surface of the cup body, the second body coating layer and the cup body interfacing at a second ion implantation bond.

19. The painting installation component of claim 18, wherein the first and second body coating layers at least partially overlap.

20. The painting installation component of claim 19, wherein the first and second body coating layers vary in at least one of ductility, roughness, and material composition.

* * * * *